US009334590B2

(12) United States Patent
Fujita et al.

(10) Patent No.: US 9,334,590 B2
(45) Date of Patent: May 10, 2016

(54) SHEET MANUFACTURING APPARATUS

(71) Applicant: SEIKO EPSON CORPORATION, Tokyo (JP)

(72) Inventors: Shigeo Fujita, Nagano (JP); Katsuhito Gomi, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,440

(22) Filed: Sep. 15, 2014

(65) Prior Publication Data

US 2015/0096705 A1 Apr. 9, 2015

(30) Foreign Application Priority Data

Oct. 3, 2013 (JP) ..... 2013-207966

(51) Int. Cl.
*D04H 1/00* (2006.01)
*D21F 9/00* (2006.01)

(52) U.S. Cl.
CPC ... *D04H 1/00* (2013.01); *D21F 9/00* (2013.01)

(58) Field of Classification Search
CPC ..... D21F 7/12
USPC ..... 162/438
See application file for complete search history.

(56) References Cited

U.S. PATENT DOCUMENTS

| | | | | |
|---|---|---|---|---|
| 4,300,981 | A * | 11/1981 | Carstens | 162/109 |
| 6,673,204 | B2 * | 1/2004 | Takai et al. | 162/115 |
| 6,736,935 | B2 * | 5/2004 | Hermans et al. | 162/109 |
| 6,797,117 | B1 * | 9/2004 | McKay et al. | 162/158 |
| 7,524,399 | B2 * | 4/2009 | Hermans et al. | 162/123 |
| 7,691,230 | B2 * | 4/2010 | Scherb et al. | 162/116 |
| 7,914,648 | B2 * | 3/2011 | Chan et al. | 162/295 |
| 2014/0027075 | A1 | 1/2014 | Yamagami et al. | |
| 2015/0096703 | A1 * | 4/2015 | Fujita et al. | 162/286 |
| 2015/0096706 | A1 * | 4/2015 | Gomi | 162/358.1 |

FOREIGN PATENT DOCUMENTS

JP 2012-144826 A 8/2012

* cited by examiner

*Primary Examiner* — Mark Halpern
(74) *Attorney, Agent, or Firm* — Global IP Counselors, LLP

(57) ABSTRACT

A sheet manufacturing apparatus includes a transferring unit configured to transfer a web which includes fibers and resin and accumulates on the transferring unit, and a heating unit configured to heat the web. The transferring unit has a first surface onto which the web is transferred, and a second surface onto which the web is transferred and which is positioned on a downstream side of the first surface in the transfer direction of the web, and an angle which is formed by the first surface and the second surface is less than 90 degrees.

12 Claims, 5 Drawing Sheets

SHEET MANUFACTURING APPARATUS

CROSS-REFERENCE TO RELATED APPLICATIONS

This application claims priority to Japanese Patent Application No. 2013-207966 filed on Oct. 3, 2013. The entire disclosure of Japanese Patent Application No. 2013-207966 is hereby incorporated herein by reference.

BACKGROUND

1. Technical Field

The present invention relates to a sheet manufacturing apparatus.

2. Related Art

In the prior art, there is known a paper recycling apparatus which is provided with a paper forming device where defibrated material accumulates on a mesh belt, a pair of transfer rollers which passes across the defibrated material, which accumulates on the mesh belt, from the mesh belt, and a cutting device which cuts the defibrated material which is being transferred (for example, refer to Japanese Examined Patent Application Publication No. 2012-144826).

However, the transfer rollers in the paper recycling apparatus described above are arranged in a horizontal direction to be adjacent with regard to the mesh belt. As a result, there are problems in that the configuration of the apparatus increases in size and the area for installing the apparatus is larger.

SUMMARY

The present invention is carried out in order to solve a portion of the problems described above and is able to be realized as the following aspects and applied examples.

A sheet manufacturing apparatus according to the present applied example comprises a transferring unit configured to transfer a web that includes fibers and resin and accumulates on the transferring unit, and a heating unit configured to heat the web. The transferring unit has a first surface onto which the web is transferred and a second surface onto which the web is transferred and which is positioned on a downstream side of the first surface in a transfer direction of the web, and an angle which is formed by the first surface and the second surface is less than 90 degrees.

According to this configuration, the first surface and the second surface of the transferring unit are configured to be less than 90 degrees and the web is transferred to fit with the first surface and the second surface. Due to this, it is possible to shorten the length of the apparatus in the horizontal direction compared to a configuration where the first surface and the second surface are arranged to be adjacent in the horizontal direction. Accordingly, it is possible to reduce the area for installing the apparatus.

In the sheet manufacturing apparatus according to the applied example described above, the transfer direction of the second surface is downward in a vertical direction.

According to this configuration, the web, which is being transferred in the horizontal direction using the first surface, is pass across by the second surface which is arranged to face downward in the vertical direction by being peeled from the first surface due to the weight of the web itself at an end section of the first surface. Due to this, it is possible to simplify the configuration of the apparatus since a peeling facility such as a blade is not necessary for peeling the web from the first surface at an end section of the first surface when the web is transferred from the first surface to the second surface. In addition, it is possible to prevent damage of the web or the like being generated due to a peeling blade or the like.

In the sheet manufacturing apparatus according to the applied example described above, a surface of the web which is in contact with the first surface and a surface of the web which is in contact with the second surface are different each other.

According to this configuration, the surface of the web, which is being transferred while in contact with the first surface, is transferred by the direction being changed to the reverse surface side on the second surface. In this manner, it is possible to increase the ease of peeling of the surfaces onto which the web is transferred and to improve the ease of transferring of the web since it is opposing surfaces of the web which comes into contact with the transfer path.

The transferring unit of the sheet manufacturing apparatus according to the applied example described above further has a third surface onto which the web is transferred on the downstream side of the second surface in the transfer direction of the web, and an angle which is formed by the third surface and the second surface is equal to or less than 150 degrees.

According to this configuration, the web is transferred by the first surface and the second surface having a first angle and the second surface and the third surface having an angle in the reverse direction to the first angle. In other words, the transfer path over which the web is transferred is configured in substantially a Z shape. Furthermore, in other words, the transfer path over which the web is transferred is configured to loop back twice. Due to this, it is possible to shorten the length of the apparatus in the vertical direction and in the horizontal direction.

The transferring unit of the sheet manufacturing apparatus according to the applied example described above has a first transferring unit which includes the first surface and a second transferring unit which has the second surface.

According to this configuration, it is possible to simplify the configuration of the transferring unit by being divided up into the first transferring unit which has the first surface and the second transferring unit which has the second surface. Furthermore, it is possible to easily set the angle which is formed by the first surface and the second surface.

In the sheet manufacturing apparatus according to the applied example described above, the first transferring unit includes an endless belt, a first roller, a second roller, and a third roller which are arranged in an order of the first roller, the second roller, and the third roller along a movement direction of the endless belt, the first surface on which material accumulates and which is a portion of the endless belt which is stretched between the first roller and the second roller, a fourth surface which is a portion of the endless belt and is stretched between the second roller and the third, a fifth surface which is a portion of the endless belt and is stretched between the third roller and another roller that is provided on a downstream side with regard to the third roller in the movement direction of the endless belt. The angle which is formed by the fifth surface and the second surface is larger than the angle which is formed by the fourth surface and the second surface.

The web on the fourth surface normally moves to the second surface side by being peeled from the endless belt due to the weight of the web itself, but a rare case where the web does not peel at the fourth surface is also assumed. Therefore, in this configuration, the angle which is formed by the fifth surface and the second surface is configured to be larger than the angle which is formed by the fourth surface and the second surface. Due to this, since the angle which is formed by the second surface at the third surface quickly increases, it is possible to increase the action of the weight of the web itself and to reliably peel the web from the endless belt.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention will be described below with reference to the drawings. Here, the dimensions of each member and the like are shown as different to the actual dimensions in each of the following diagrams in order for each member and the like to be a size which is visually recognizable.

First, the configuration of a sheet manufacturing apparatus will be described. The sheet manufacturing apparatus is based on a technique where, for example, a raw material (material to be defibrated) Pu such as a fresh pulp sheet or used paper is formed into a new sheet Pr. As the used paper Pu which is supplied to the sheet manufacturing apparatus, there is, for example, sheets of A4 size paper and the like which is currently in mainstream use in offices. The sheet manufacturing apparatus according to the present applied example is provided with a transferring unit onto which a web, which accumulates by including fibers and resin, is transferred, and a heating unit which heats the web, where the transferring unit has a first surface onto which the web is transferred and a second surface onto which the web is transferred and which is positioned on the downstream side of the first surface in the transfer direction of the web, and the angle which is formed by the first surface and the second surface is set to be less than 90 degrees. Here, the web according to the present embodiment refers to the configuration format of an object which includes fibers and resin. Accordingly, a case where the format such as the dimensions changes during heating, pressurizing, cutting, transferring, or the like of the web is included as the web. The configuration of the sheet manufacturing apparatus will be described in detail below.

Figure 1:
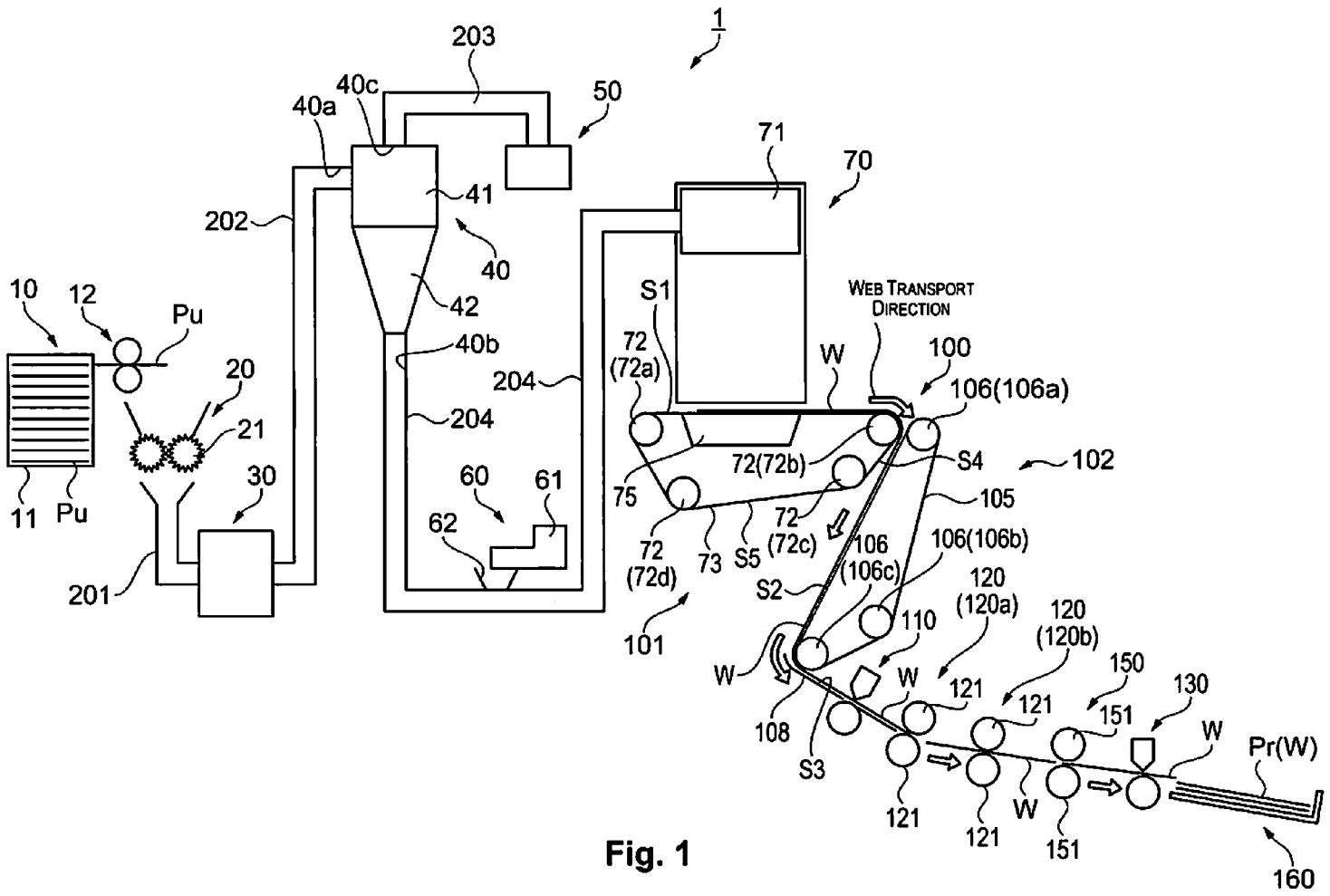
FIG. 1 is a schematic diagram illustrating a configuration of a sheet manufacturing apparatus.
Figure 2:
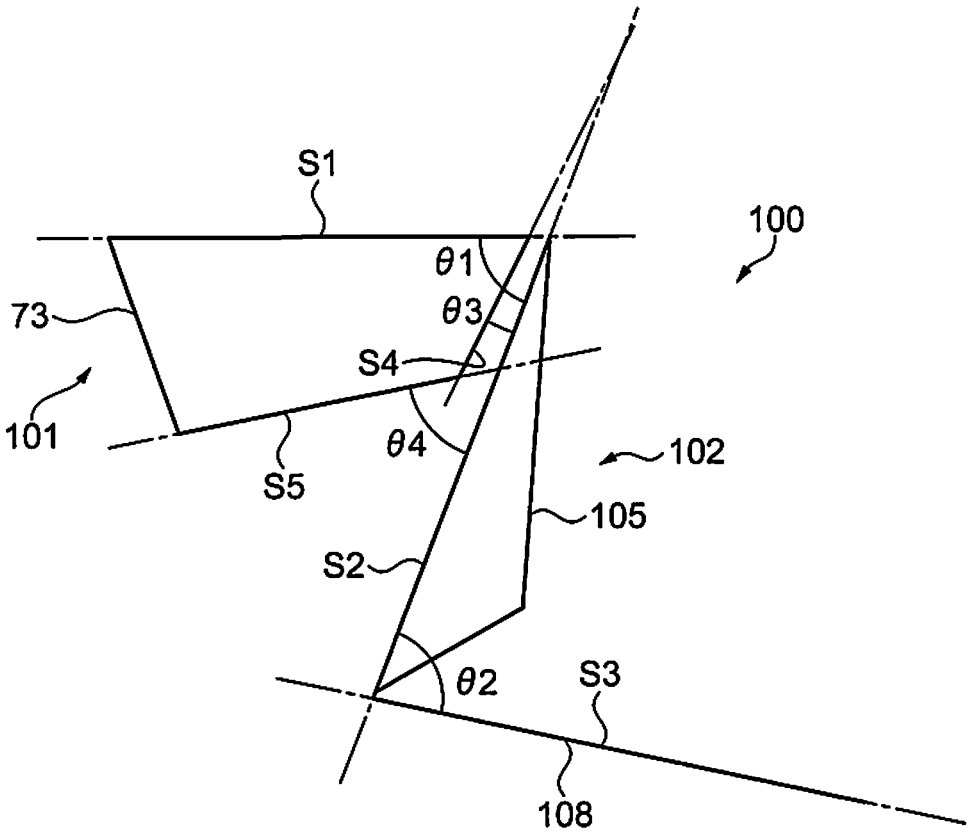
FIG. 2 is a schematic diagram illustrating a configuration of a portion of a sheet manufacturing apparatus.
Figure 3A:
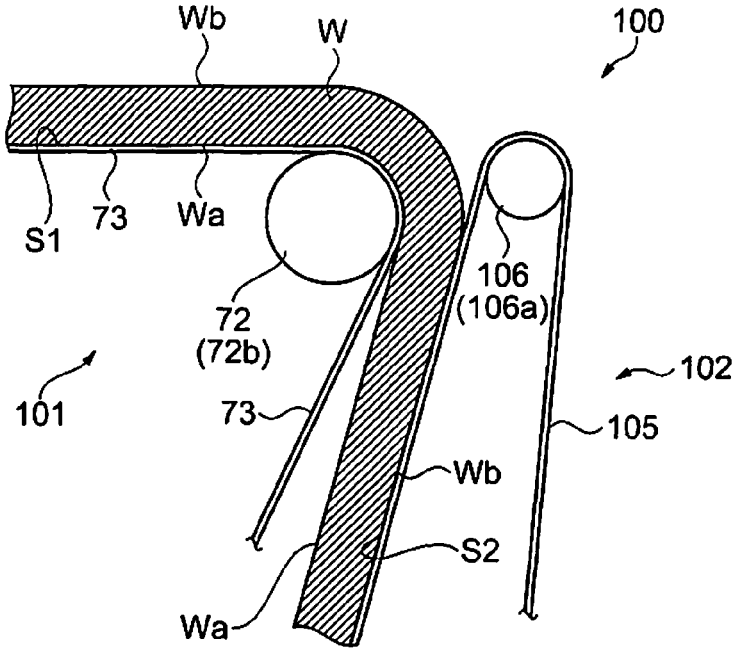
FIG. 3A is a partially enlarged diagram illustrating a configuration of a sheet manufacturing apparatus.
Figure 3B:
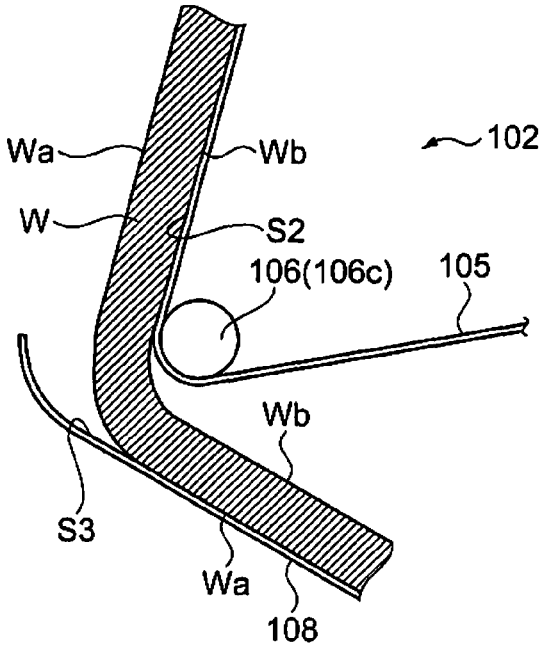
FIG. 3B is a partially enlarged diagram illustrating the configuration of the sheet manufacturing apparatus.

FIG. 1 is a schematic diagram illustrating the configuration of the sheet manufacturing apparatus. FIG. 2 is a schematic diagram illustrating a portion of the configuration of the sheet manufacturing apparatus. FIGS. 3A and 3B are partially enlarged diagrams illustrating a configuration of the sheet manufacturing apparatus. As shown in FIG. 1, a sheet manufacturing apparatus 1 is provided with a supplying unit 10, a crushing unit 20, a defibrating unit 30, a classifier unit 40, a receiving unit 50, an additive agent feeding unit 60, a web forming unit 70, a transferring unit 100, and heating units 120. Furthermore, a first cutting unit 110, a second cutting unit 130, a cooling unit 150 and the like are provided in the sheet manufacturing apparatus 1.

The supplying unit 10 supplies used paper Pu to the crushing unit 20. The supplying unit 10 is provided with, for example, a tray 11 where a plurality of sheets of the used paper Pu are stacked, an automatic sending mechanism 12 where the used paper Pu in the tray 11 is able to be continuously fed into the crushing unit 20. As the used paper Pu which is supplied to the sheet manufacturing apparatus 1, there is, for example, sheets of A4 size paper and the like which is currently in mainstream use in offices.

The crushing unit 20 cuts the used paper Pu which is supplied into pieces of paper which are squares of several centimeters. A crushing blade 21 is provided in the crushing unit 20 and an apparatus is configured such that the cutting width of the blade of a normal shedder is widened. Due to this, it is possible to easily cut the used paper Pu which is supplied into pieces of paper. Then, the crushed paper which is cut up is supplied to the defibrating unit 30 via a pipe 201.

The defibrating unit 30 is provided with a rotating blade which rotates (which is not shown in the diagram) and disentangles and defibrates the crushed paper which is supplied from the crushing unit 20 into a fibrous state. Here, the defibrating unit 30 of the present embodiment performs defibrating in air with a dry type. Due to a defibrating process using the defibrating unit 30, paper coating materials such as printing ink or toner or a stain preventing material become particles of several tens of μm or less (referred to below as "ink particles") and are defibrated with the fibers. Accordingly, the defibrated material which is output from the defibrating unit 30 is fibers and ink particles which are obtained due to defibrating the pieces of paper. Then, there is a mechanism where a flow of air is generated by the rotation of the rotating blade and fibers which are defibrated are transferred to the classifier unit 40 via a pipe 202 due to being caught by the flow of air. Here, in a case of using the defibrating unit 30 with a dry type where a wind generating mechanism is not provided, it is sufficient if an air flow generating apparatus, which generates a flow of air from the crushing unit 20 to the defibrating unit 30, is separately provided.

The classifier unit 40 classifies the defibrated material into ink particles and fibers. In the present embodiment, a cyclone is applied as the classifier unit 40 (the classifier unit will be described below as the cyclone 40) and the fibers which is transferred is classified using the flow of air into ink particles and deinked fibers (deinked defibrated material). Here, another type of classifier device with an air flow system may be used instead of the cyclone 40. In this case, for example, an elbow jet, an eddy classifier, or the like may be used as the classifier device with an air flow system other than the cyclone 40. The classifier device with an air flow system generates a revolving flow of air and, by separating and classifying using differences in centrifugal force which is received according to the size and density of the defibrated material, it is possible to adjust the classifying points by adjusting the speed or centrifugal force of the air flow. Due to this, ink particles which are comparatively small and have a low density and fibers which are larger and have a higher density than ink particles are divided up. Removing of ink particles from fibers is referred to as deinking.

Here, the cyclone 40 has a relatively simple structure as a tangential input type of cyclone. The cyclone 40 of the present embodiment is configured from an introduction port 40*a* with introduction from the defibrating unit 30, a cylindrical unit 41 which is joined to the introduction port 40*a* in the tangential direction, a conical unit 42 which is continuous with a lower section of the cylindrical unit 41, a lower output unit 40*b* which is provided at a lower section of the conical unit 42, and an upper exhaust port 40*c* for discharging fine particles which is provided in the center of an upper section of the cylindrical unit 41. The diameter of the conical unit 42 becomes smaller heading downward in the vertical direction.

In a classifying process, the flow of air, which catches the defibrated materials which are introduced from the introduction port 40*a* of the cyclone 40, is changed to a circular action by the cylindrical unit 41, a centrifugal force is applied, fibers become increasingly entangled and are moved to the conical unit 42 due to interaction with the flow of air. In addition, ink particles which are separated are lead out to the upper exhaust port 40*c* as fine particles along with air and there is progress in deinking. Then, a mixture of short fibers which includes a large amount of ink particles is discharged from the upper exhaust port 40*c* of the cyclone 40. Then, the discharged mixture of short fibers which includes a large amount of ink particles is recovered by the receiving unit 50 via a pipe 203 which is connected with the upper exhaust port 40*c* of the cyclone 40. On the other hand, deinked fibers are transferred from the lower output unit 40*b* of the cyclone 40 toward the web forming unit 70 via a pipe 204. Here, the deinked fibers may be sucked in from the upper exhaust port 40*c*.

In addition, the additive agent feeding unit 60, which adds additive agents such as resins (for example, a fusion-bondable resin or a thermosetting resin) with regard to the deinked fibers which are transferred, is provided within the pipe 204 which transfers the deinked fibers from the cyclone 40 to the web forming unit 70. Here, it is possible for, for example, a fire retarding agent, a whiteness improving agent, a sheet strength reinforcing agent, a sizing agent, and the like to be fed in as an additive agent along with fusion-bondable resins. These additive agents are retained in an additive agent retaining unit 61 and are fed in from a feeding port 62 using a feeding mechanism which is not shown in the diagram.

The web forming unit 70 forms the web which includes fibers and resin which are fed in from the pipe 204. The web forming unit 70 has a mechanism which uniformly disperses fibers in the air and a mechanism which accumulates the fibers which are dispersed on a mesh belt 73 which is an endless belt.

First, a forming drum 71, where fibers and resin are feed into an inner section of the forming drum 71, is arranged in the web forming unit 70 as the mechanism which uniformly disperses fibers in the air. Then, it is possible to uniformly mix the resin (additive agents) into the fibers by the forming drum 71 being driven to rotate. A screen which has a plurality of small holes is provided on the surface of the forming drum 71. In addition, a needle roller which is able to rotate is provided in an inner section of the forming drum 71 so that the fibers which are fed in float. Due to this configuration, it is possible to uniformly disperse the fibers which pass through the small holes in the air.

On the other hand, the transferring unit 100 is arranged below the forming drum 71 and is configured to transfer a web W which accumulates. The transferring unit 100 of the present embodiment is provided with a first transferring unit 101 and a second transferring unit 102. The endless mesh belt 73, where a mesh which is stretched by stretching rollers 72 (four stretching rollers 72*a* to 72*d* in the present embodiment) is formed, is arranged in the first transferring unit 101. Then, the mesh belt 73 moves in one direction due to driving of at least one of the stretching rollers 72.

In addition, a suction apparatus 75, which is a suction unit which generates a flow of air vertically downward through the mesh belt 73, is provided vertically below the forming drum 71 via the mesh belt 73. Using the suction apparatus 75, it is possible to suck the fibers which are dispersed in the air onto the mesh belt 73.

Then, when the fibers in a tangled state are introduced from the cyclone 40 into the forming drum 71 of the web forming unit 70, fibers and resin are untangled using the needle roller and the like. Then, the untangled fibers are passed through the screen with small holes in the surface of the forming drum 71 and are accumulated on the mesh belt 73 using suction force from the suction apparatus 75. At this time, it is possible to form the web W where fibers and resin accumulate with a lengthwise shape due to the mesh belt 73 being moved in one direction. The web W is formed with a continuous shape by dispersing from the forming drum 71 and moving of the mesh belt 73 being continuously performed. Here, the mesh belt 73 may be made of metal, resin, or nonwoven material and the mesh belt 73 may be any type of belt as long as fibers are accumulated and a flow of air passes through. Here, fibers enter in between the mesh and there are irregularities when the web (sheet) is formed if the diameter of the holes in the mesh of the mesh belt 73 is too large, and on the other hand, it is difficult to form a stable flow of air using the suction apparatus 75 if the diameter of the holes in the mesh are too small. As a result, it is preferable for the diameter of the holes in the mesh to be appropriately adjusted. It is possible to configure the suction apparatus 75 so that a closed box is formed with a window with a desired size opened below the mesh belt 73, air is sucked in from a location other than the window, and there is a negative pressure in the box compared to the outside air.

The web W which is formed on the mesh belt 73 is transferred using the first transferring unit 101. In detail, first, the web W, which is formed on a first surface S1 of the mesh belt 73 of the first transferring unit 101, is transferred to the right side in the horizontal direction in FIG. 1 due to the mesh belt 73 being driven to rotate. Then, the web W, which comes to an end section on the right side of the mesh belt 73 (a portion which corresponds to the second roller 72*b*), is transferred downward while adhering to the mesh belt 73 according to the transfer direction (the arrows in the diagram). Here, the angle (which is equivalent to θ1-θ3 in FIG. 2), which is formed by the first surface S1 on the mesh belt 73 and a fourth surface S4 of the mesh belt 73 which stretches between the second roller 72*b* and the third roller 72*c*, is less than 90 degrees. As a result, the web W is peeled from the surface S4 due to its own weight. Due to this, the web W is transferred by being passed across from the first transferring unit 101 to the second transferring unit 102.

An endless transfer belt 105, which stretches using stretching rollers 106 (three stretching rollers 106*a* to 106*c* in the present embodiment), is arranged in the second transferring unit 102. Then, the transfer belt 105 moves in one direction due to driving of at least one of the stretching rollers 106. Then, the web W is passed across from the first surface S1 of the first transferring unit 101 to the second surface S2 of the second transferring unit 102 and is transferred according to the transfer direction (the arrows in the diagram). Here, the transfer direction of the second surface S2 is downward in the vertical direction. In addition, the second surface S2 is positioned on the downstream side of the first surface S1 in the transfer direction of the web W. Then, as shown in FIG. 2, a first angle θ1, which is formed by the first surface S1 on the mesh belt 73 which is the surface onto which the web W is transferred and the second surface S2 on the transfer belt 105 which is the surface onto which the web W is transferred, is set to the less than 90 degrees. Here, θ1 is larger than θ3. That is, as shown in FIG. 3A, when transferring to the second surface S2 side, the web W which accumulates on the first surface S1 is passed across to the second surface S2 which is arranged facing downward by being peeled from the first surface S1 due to the weight of the web W itself at an end section of the first surface S1 (near where the second roller 72*b* has been passed in the transfer direction). Due to this, it is possible to simplify the transfer configuration when the web W is transferred from the first surface S1 to the second surface S2 since it is not necessary to install a blade or the like for peeling the web W at an end section of the first surface S1. In addition, damage of the web W or the like due to a peeling blade or the like is not generated. Here, the first angle θ1 according to the present embodiment is an angle which is formed by the first surface S1 and the second surface S2 and is not an angle which is formed by the web W which is being transferred.

In addition, as shown in FIG. 3A, a surface Wa of the web W which is in contact with the first surface S1 and a surface Wb of the web W which is in contact with the second surface S2 are different when the web W is passed across from the first surface S1 to the second surface S2. In detail, the surface Wa is in contact with the first surface S1 in the thickness direction of the web W when the web W is formed (accumulates) on the first surface S1 of the mesh belt 73. Accordingly, the surface Wb of the web W on the first surface S1 is not in contact with the first surface S1. Then, the first surface S1 and the surface Wa of the web W peel due to the weight of the web W itself at an end section of the second surface S2 (near where the stretching rollers 72 have been passed in the transfer direction) when the web W is passed across from the first surface S1 to the second surface S2. Then, the second surface S2 is in contact with the surface Wb of the web W and the surface Wa of the web W is not in contact with the second surface S2 when the web W is passed across from the first surface S1 to the second surface S2. Since the surfaces for transferring the web W are reversed during transfer in this manner, it is possible to appropriately increase the ease of peeling and improve the ease of transferring.

In addition, as shown in FIG. 1, the transferring unit 100 of the present embodiment has a third surface S3 onto which the web W is transferred on the downstream side of the second transferring unit 102 in the transfer direction of the web W. It is possible for the third surface S3 to be configured as a surface for transferring the web W in, for example, a guide 108 onto which the web W is transferred. Then, as shown in FIG. 2, a second angle θ2, which is formed by the third surface S3 and the second surface S2, is equal to or less than 150 degrees. That is, there is a configuration in the present embodiment where the web W is transferred by the first surface S1 and the second surface S2 having the first angle θ1 and the second surface S2 and the third surface S3 having the second angle θ2 which is in the reverse direction to the first angle θ1. In other words, the transfer path over which the web W is transferred is configured in substantially a Z shape. Here, the second angle θ2 according to the present embodiment is an angle which is formed by the second surface S2 and the third surface S3 and is not an angle which is formed by the web W which is being transferred.

In addition, as shown in FIG. 3B, the surface Wb of the web W which is in contact with the second surface S2 and the surface Wa of the web W which is in contact with the third surface S3 are different when the web W is passed across from the second surface S2 to the third surface S3. In detail, the surface Wb is in contact with the second surface S2 in the thickness direction of the web W when the web W is transferred to the second surface S2. Accordingly, the surface Wa of the web W on the second surface S2 is not in contact with the second surface S2. Then, the second surface S2 and the surface Wb of the web W peel due to the weight of the web W itself at an end section of the second surface S2 (near the stretching rollers 106*c*) when the web W is passed across from the second surface S2 to the third surface S3. Then, the surface Wa of the web W is in contact with the third surface S3 and the surface Wb of the web W is not in contact with the third surface S3 when the web W is passed across from the second surface S2 to the third surface S3. Since the surfaces for transferring the web W are reversed during transfer in this manner, it is possible to increase the ease of peeling of the web W and the transfer path and to further improve the ease of transferring. Then, as described above, it is possible to shorten the length for installing the sheet manufacturing apparatus 1 in the horizontal direction due to configuring the transfer path which uses the weight of the web W itself.

Here, the web W is normally transferred to the second surface S2 side by the web W being peeled from the first surface S1 at an end section of the first surface S1 of the mesh belt 73 as described above when transferring the web W while using the weight of the web W itself, but a rare case where the web W is transferred without peeling from the mesh belt 73 is also assumed.

Therefore, in the present embodiment, the first transferring unit 101 is provided with the mesh belt 73 which is the endless belt and a first roller 72*a*, a second roller 72*b*, and a third roller 72*c* around which the mesh belt 73 is wound (stretched) as shown in FIG. 1 and FIG. 2. Then, the first roller 72*a*, the second roller 72*b*, and the third roller 72*c* are arranged in this order along the movement direction of the mesh belt 73. There is a configuration where a portion of the mesh belt 73 which is stretched between the first roller 72*a* and the second roller 72*b* is the first surface S1 where material which includes fibers and resin accumulates, a portion of the mesh belt 73 which is stretched between the second roller 72*b* and the third roller 72*c* is the fourth surface S4, a portion of the mesh belt 73 which is stretched between the third roller 72*c* and a fourth roller 72*d*, which is another roller which is provided on the downstream side with regard to the third roller 72*c* in the movement direction of the mesh belt 73, is a fifth surface, and a fourth angle θ4 which is formed by the fifth surface S5 and the second surface S2 is larger than a third angle θ3 which is formed by the fourth surface S4 and the second surface S2. Since the angle which is formed by the second surface S2 in the vicinity of the third surface S3 quickly increases due to the fourth angle θ4 which is formed by the fifth surface S5 and the second surface S2 being larger than the third angle θ3 which is formed by the fourth surface S4 and the second surface S2 in this manner, it is possible to increase the action of the weight of the web W itself and to reliably peel the web W from the mesh belt 73. Here, the first to fourth angles θ1, θ2, θ3, and θ4 according to the present embodiment are angles with the respective surfaces of the transferring unit 100 and are not angles which are formed by the web W which is being transferred.

A first cutting unit 110, which cuts the web W in a direction which intersects with the transfer direction of the web W which is being transferred, is arranged on the downstream side of the second transferring unit 102 (the second surface S2) in the transfer direction of the web W. The first cutting unit 110 is provided with a cutter and cuts the web W with a continuous shape into sheet shapes according to a cutting position which is set to a predetermined length. Due to this, the web W changes from a continuous shape to sheet shapes and it is possible to reduce skew or the like being generated due to transferring of the web W since the length dimension of the web W is shorter in the transfer direction and it is easier to correct skew.

Then, heating units 120, which heat the web W which is cut, are arranged on the downstream side of the first cutting unit 110 in the transfer direction of the web W. The heating units 120 bond the fibers which are included in the web W to each other through the resin. Here, in the present embodiment, the heating units 120 (120*a* and 120*b*) are provided in two locations. In detail, the heating unit 120*a* is arranged on the downstream side of the first cutting unit 110 in the transfer direction of the web W and the heating unit 120*b* is arranged on the downstream side of the heating unit 120*a* in the transfer direction of the web W. Then, each of the heating units 120*a* and 120*b* are provided with a pair of first heating rollers 121. A heating member such as a heater is provided in a central section of the rotation shaft off the first heating rollers 121 and it is possible to heat and pressurize the web W which is being transferred by the web W being passed through between the pairs of first heating rollers 121. Then, it is easy for the resin to melt and the fibers to become entangled while the gaps between fibers are shortened and the points of contact between fibers are increased by heating and pressurizing the web W using the pair of first heating rollers 121. Due to this, the strength of the web W is improved by increasing the density. Furthermore, in the present embodiment, by providing the heating units 120 (120*a* and 120*b*) at two locations, it is possible to ensure sufficient time for heating and pressurizing and it is possible to reliably improve the strength of the web W. In addition, due to the heating units 120 being configured as the heating rollers 121, it is possible to form a sheet while continuously transferring the web compared to a case where the heating units 120 are configured as a pressing apparatus with a plate shape. In a case where a pressing apparatus with a plate shape is used, a buffer unit, where the web which is being transferred in temporarily held, is necessary between pressings. That is, it is possible to reduce the size of the configuration of the entirety of the sheet manufacturing apparatus 1 by using the heating rollers 121.

There is the cooling unit 150 which cools the web W on the downstream side of the heating units 120 in the transfer direction of the web W. The cooling unit 150 is a unit which does not heat the web W. The cooling unit 150 is not provided with a heating unit such as a heater. The cooling unit 150 of the present embodiment is provided with a pair of cooling rollers 151. Accordingly, the cooling unit 150 cools the web W and pressurizes the web W. Due to this, the cooling unit 150 has a function of lowering the temperature of the web W and improving the strength of the web W. The cooling rollers 151 have, for example, an air cooling mechanism which is provided with a hollow metal core and an air injecting unit which injects air into the hollow section of the metal core. Due to this, there is a configuration where the temperature of the cooling rollers 151 is not raise to be equal to or more than the temperature of the web W which is heated when coming into contact with the web W which is heated by the heating units 120. In more detail, there is a configuration where the heat is released from the web W via the cooling rollers 151 and the temperature of the web W approaches room temperature due to the cooling rollers 151 and the web W coming into contact. Due to this, fibers are reliably bonded to each other through the resin due to the web W being cooled and the melted resin hardening by being cooling. Here, the cooling system of the present embodiment is not limited to the cooling unit 150 and cooling is not necessary as long as heating is properly performed. In a case of cooling, for example, a water cooling system may be used.

A second cutting unit 130, which cuts the web W along the transfer direction of the web W, is arranged on the downstream side of the cooling unit 150 in the transfer direction of the web W. The second cutting unit 130 is provided with a cutter and cuts the web W according to a predetermined cutting position in the transfer direction of the web W. Due to this, the sheet Pr (the web W) is formed in a desired size. Then, the sheet Pr (the web W) which is cut is stacked in the stacker 160 or the like. Accordingly, in the present embodiment, the web W is cut along the transfer direction using the second cutting unit 130 in a state where skew is reduced by first cutting the web W which is being transferred into sheet shapes using the first cutting unit 110. As a result, it is possible to effectively cut the web W into the desired dimensions.

According to the embodiment described above, it is possible to obtain the following effects.

Since the first angle θ1 of the first surface S1 and the second surface S2 of the transferring unit 100 is configured to the less than 90 degrees, it is possible for the first surface S1 and the web W to easily peel using the weight of the web W itself at an end section of the first surface S1 and it is possible to effectively pass across the web W to the second surface S2. In addition, it is possible to simplify the configuration of the apparatus since a blade or the like is not necessary to peel the web W from the first surface S1 when the web W is peeled from the mesh belt 73. In addition, it is possible to prevent damage of the web W or the like being generated due to a peeling blade or the like. Then, it is possible to shorten the length of the sheet manufacturing apparatus 1 in the horizontal direction by structuring the transfer path so that the web W is transferred over a Z shape Here, the sheet according to the present embodiment is mainly referred to as a sheet with a sheet shape where the raw material is fiber. However, the sheet is not limited to this and may be a board shape or a web sheet (or a shape with irregularities). In addition, the sheet may be use plant fibers such as cellulose, chemical fibers such as PET (polyethylene-telephthalate) or polyester, or animal fibers such as wool or silk as raw materials. The sheet in the present application can be divided into paper or nonwoven material. Paper includes fresh pulp or used paper as raw materials, includes formats such as thin sheet shapes, and includes recording paper, wall paper, wrapping paper, colored paper, drawing paper, and the like with the aim of writing or printing. Nonwoven material includes nonwoven material, fiber board, tissue paper, kitchen paper, cleaning paper, filters, liquid absorbing materials, sound absorbing bodies, shock absorbing materials, mats, and the like with greater thickness and lower strength compared to paper.

The present invention is not limited to the embodiment described above and various modifications and alterations may be added to the embodiment described above. Modified examples are described below.

Modified Example 1

Figure 4:
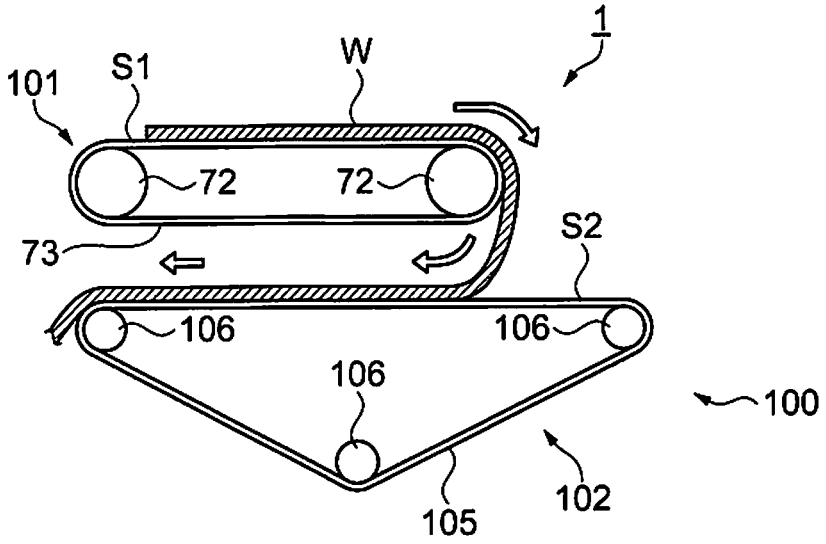
FIG. 4 is a schematic diagram illustrating a configuration of a portion of a sheet manufacturing apparatus according to modified example 1.

The upper limit of the first angle θ1, which is formed by the first surface S1 and the second surface S2, is set to the less than 90 degrees in the embodiment described above, but the lower limit of the first angle θ1, which is formed by the first surface S1 and the second surface S2, may be 0 degrees. FIG. 4 is a schematic diagram illustrating a configuration of a portion of a sheet manufacturing apparatus according to modified example 1. As shown in FIG. 4, there is a configuration where the first transferring unit 101 has the mesh belt 73 and two of the stretching rollers 72 around which the mesh belt 73 is wound and the mesh belt 73 moves in one direction due to driving of at least one of the stretching rollers 72. In addition, the second transferring unit 102 is arranged below the first transferring unit 101. Then, there is a configuration where the second transferring unit 102 has the transfer belt 105 and a plurality of the stretching rollers 106 around which the transfer belt 105 is wound and the transfer belt 105 moves in one direction due to driving of at least one of the stretching rollers 106. Here, the second transferring unit 102 is arranged so that the second surface S2 is longer than the first surface S1 in the horizontal direction so that it is possible to reliably pass across the web W which is being transferred from the first surface S1. Then, the angle of the first surface S1 onto which the web W, which is formed on the mesh belt 73, is transferred and the second surface S2 of the transfer belt 105 onto which the web W, which is being transferred from the first surface S1, is passed across is 0 degrees, that is, the first surface S1 and the second surface S2 are arranged to be parallel. Even doing this, it is possible to pass across the web W, which is being transferred in the horizontal direction using the first surface S1, using the second surface S2 which is arranged below the first surface S1 by being peeled from the first surface S1 using the weight of the web W itself at an end section of the first surface S1. In addition, it is possible to further shorten the length of the sheet manufacturing apparatus 1 in the horizontal direction since an arrangement is possible where the first transferring unit 101 and the second transferring unit 102 overlap in a planar view.

Modified Example 2

Figure 5:
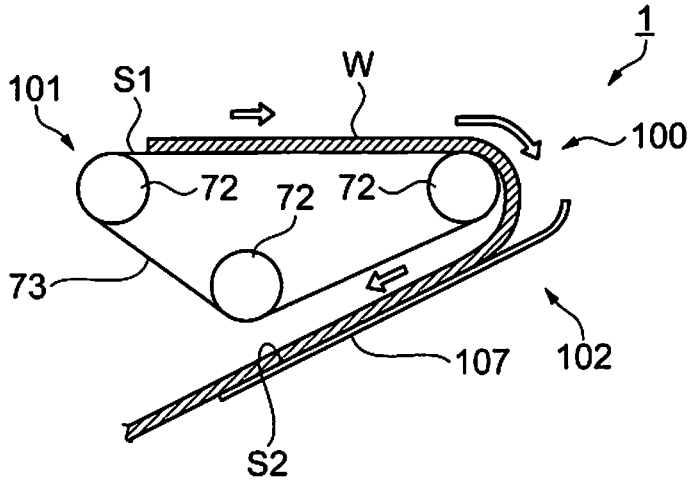
FIG. 5 is a schematic diagram illustrating a configuration of a portion of a sheet manufacturing apparatus according to modified example 2.

There is a configuration in the embodiment described above where the first transferring unit 101 and the second transferring unit 102 are provided as the transferring unit 100 and the transfer belt 105 is provided as the second transferring belt 102, but the configuration is not limited to this. FIG. 5 is a schematic diagram illustrating a configuration of a portion of a sheet manufacturing apparatus according to modified example 2. As shown in FIG. 5, the transferring unit 100 is provided with the first transferring unit 101 and the second transferring unit 102. Then, the second transferring unit 102 is provided with a transfer guide 107. The transfer guide 107 is a member with a flat surface where, for example, stainless steel is used. Due to this, it is possible to reduce friction resistance with the web W. Then, a surface of the transfer guide 107 configures the second surface S2 and the first angle θ1, which is formed by the first surface S1 of the mesh belt 73 of the first transferring unit 101 and the second surface S2 of the transfer guide 107, is configured to the less than 90 degrees. By doing this, the web W and the first surface S1 peel using the weight of the web W itself at an end section of the first surface S1 and the web W is passed across to the second surface S2. Then, it is possible to effectively transfer the web W due to the web W smoothly sliding in the transfer direction onto the second surface S2. In addition, it is possible to simplify the configuration of the second transferring unit 102.

Modified Example 3

Figure 6:
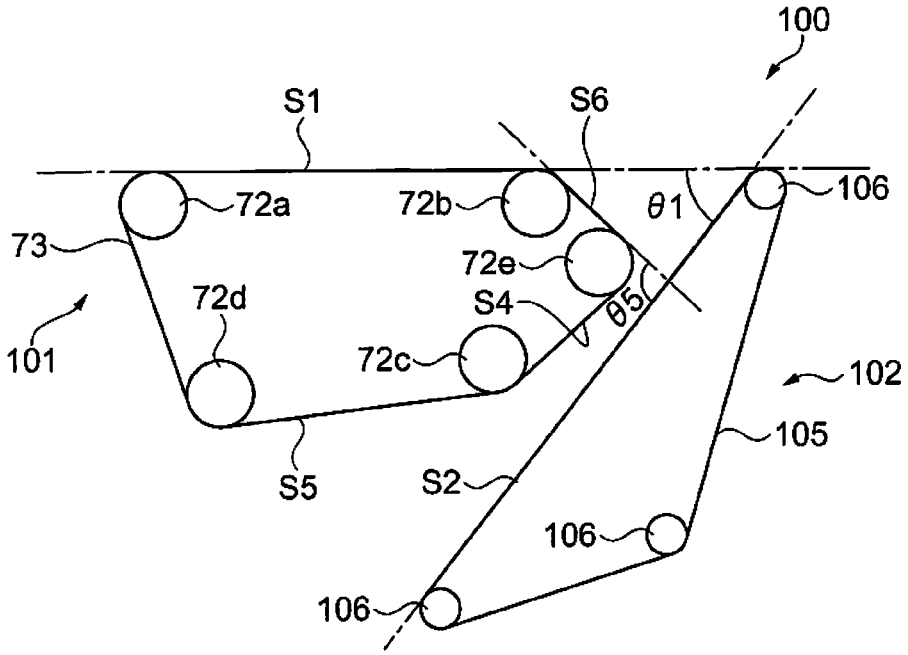
FIG. 6 is a schematic diagram illustrating a configuration of a portion of a sheet manufacturing apparatus according to modified example 3.

The web W is transferred in the embodiment described above so that the first angle θ1, which is formed by the first surface S1 and the second surface S2, is maintained so as to be less than 90 degrees when transferring by passing the web W across from the first surface S1 to the second surface S2, but the configuration is not limited to this. FIG. 6 is a schematic diagram illustrating a configuration of a portion of a sheet manufacturing apparatus according to modified example 3. As shown in FIG. 6, the first transferring unit 101 is provided with the mesh belt 73, the first roller 72*a*, the second roller 72*b*, the third roller 72*c*, and the fourth roller 72*d* around which the mesh belt 73 is wound (stretched), and a fifth roller 72*e* which is provided between the second roller 72*b* and the third roller 72*c* with regard to the movement direction of the mesh belt 73. Then, a portion of the mesh belt 73 which is stretched between the first roller 72*a* and the second roller 72*b* is the first surface S1 where a material which includes fibers and resin accumulates, and a portion of the mesh belt 73 which is stretched between the second roller 72*b* and the fifth roller 72*e* is a sixth surface S6. In this configuration, the web W which accumulates on the first surface S1 is transferred from the first surface S1 to the second surface S2 via the sixth surface S6. In this case, the first angle θ1, which is formed by the first surface S1 and the second surface S2, is less than 90 degrees, and a fifth angle θ5, which is formed by the sixth surface S6 and the second surface S2, is equal to or more than 90 degrees. That is, there may a configuration where the angle θ5, over which the web W is transferred by being transferred using another surface (S6), is 90 degrees or more when the web W is transferred from the first surface S1 to the second surface S2. That is, it is sufficient if the first angle θ1, which is formed by the first surface S1 where the material which includes fibers and resin accumulates and the second surface S2 which is positioned on the downstream side of the first surface S1 in the transfer direction of the web W, is maintained. Even doing this, it is possible to obtain the same effects as described above.

Modified Example 4

Figure 7:
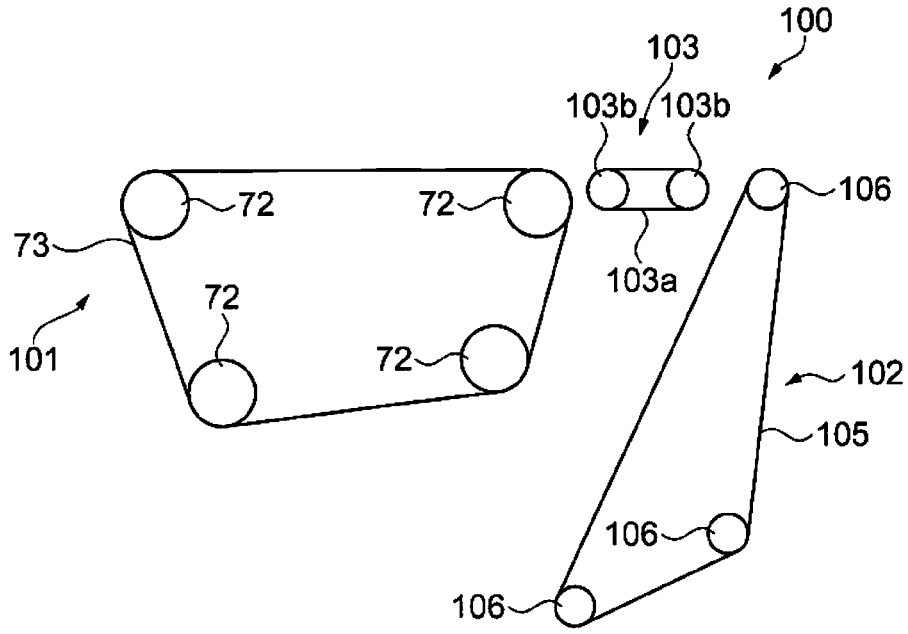
FIG. 7 is a schematic diagram illustrating a configuration of a portion of a sheet manufacturing apparatus according to modified example 4.

The web W is passed across directly from the first transferring unit 101 to the second transferring unit 102 in the embodiment described above, but the configuration is not limited to this. FIG. 7 is a schematic diagram illustrating a configuration of a portion of a sheet manufacturing apparatus according to modified example 4. As shown in FIG. 7, it is sufficient if the second surface S2 is positioned on the downstream side of the first surface S1 in the transfer direction of the web W even in a configuration where other transfer members, units, or the like are arranged on the transfer path between the first transferring unit 101 (the first surface S1) and the second transferring unit 102 (the second surface S2). In the present modified example, another transferring unit 103 is arranged between the first transferring unit 101 and the second transferring unit 102. The transferring unit 103 is provided with an endless transfer belt 103*a* and stretching rollers 103*b* (two of the stretching rollers 103*b* in the present modified example) around which the endless transfer belt 103*a* is stretched. Even doing this, it is possible to obtain the same effects as described above.

Modified Example 5

The web W which is being transferred using the transferring unit 100 is cut using the first cutting unit 110 in the embodiment described above, but the configuration is not limited to this. For example, a preliminary heating unit, which preliminarily heats the web W with a lower temperature or a lower load on the web W than the heating units 120, may be arranged on the upstream side of the first cutting unit 110 in the transfer direction of the web W. In this case, a configuration is possible where the preliminary heating unit is provided with a pair of heating and pressurizing rollers. Heating members such as heaters are provided in central sections of rotation shafts of the heating and pressurizing rollers and it is possible to heat and pressurize the web W which is being transferred by the web W being passed through between the pair of heating and pressurizing rollers. Due to this, the strength of the web W is increased. Then, the web W which passes through the preliminary heating unit is cut using the first cutting unit 110. That is, it is possible to suppress the web W from breaking down or the like during cutting and to accurately cut the web W since it is possible to cut the web W in a state where the web W is stronger.

Modified Example 6

There is a configuration in the embodiment described above where the two heating units 120*a* and 120*b* are arranged as the heating unit 120, but the configuration is not limited to this. For example, there may be a configuration where only one of the heating units 120 is arranged or there may be a configuration where three or more of the heating units 120 are arranged and there may be appropriate settings according to the thickness, material properties, and the like of the web W (the sheet Pr) which is being manufactured. By doing this, it is possible to effectively manufacture (form) the sheet Pr (the web W).

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a web forming unit configured to deposit fibers and resin to form a web;

a transferring unit configured to transfer, in a transfer direction, the web that includes the fibers and the resin deposited on the transferring unit, the transferring unit including a first transferring unit having a first surface that is flat and a second transferring unit disposed downstream in the transfer direction relative to the first transferring unit, the second transferring unit having a second surface configured to receive the web that is transferred from the first transferring unit, an angle that is formed by the first surface and the second surface being less than 90 degrees; and a heating unit configured to heat the web, the web forming unit being configured to deposit the fibers and the resin on the first surface to form the web.

2. The sheet manufacturing apparatus according to claim 1, wherein the transfer direction of the second surface is downward in a vertical direction.

3. The sheet manufacturing apparatus according to claim 2, wherein the first transferring unit includes an endless belt, and a portion of the endless belt that defines the first surface is configured to move in a horizontal direction perpendicular to the vertical direction.

4. The sheet manufacturing apparatus according to claim 1, wherein a surface of the web that is in contact with the first surface and a surface of the web that is in contact with the second surface are different each other.

5. The sheet manufacturing apparatus according to claim 1, wherein the transferring unit further has a third surface onto which the web is transferred on the downstream side of the second surface in the transfer direction of the web, and an angle that is formed by the third surface and the second surface is equal to or less than 150 degrees.

6. The sheet manufacturing apparatus according to claim 1, wherein the first transferring unit includes an endless belt, a first roller, a second roller, and a third roller that are arranged in an order of the first roller, the second roller, and the third roller along a movement direction of the endless belt, the first surface on which material accumulates and which is a portion of the endless belt and is stretched between the first roller and the second roller, a fourth surface that is a portion of the endless belt and is stretched between the second roller and the third roller, and a fifth surface that is a portion of the endless belt and is stretched between the third roller and another roller that is provided on a downstream side relative to the third roller in the movement direction of the endless belt, and an angle that is formed by the fifth surface and the second surface is larger than an angle that is formed by the fourth surface and the second surface.

7. The sheet manufacturing apparatus according to claim 1, wherein the first transferring unit further has a fourth surface that is arranged downstream in the transfer direction relative to the first surface such that the web is transferred between the second surface and the fourth surface, and an angle that is formed by the second surface and the fourth surface is less than 90 degrees.

8. The sheet manufacturing apparatus according to claim 1, wherein a length in the transfer direction of the second surface is greater than a length in the transfer direction in the first surface.

9. The sheet manufacturing apparatus according to claim 1, wherein the first surface extends horizontally relative to the sheet manufacturing apparatus.

10. The sheet manufacturing apparatus according to claim 1, wherein the second transferring unit is configured to transfer the web on the second surface in a second direction which is parallel to and opposite a first direction in which the first transferring unit is configured to transfer the web on the first surface.

11. The sheet manufacturing apparatus according to claim 1, further comprising a suction unit configured to suction the fibers and the resin such that the fibers and the resin are deposited on the first surface by a suction power of the suction unit.

12. A sheet manufacturing apparatus comprising:

a web forming unit configured to deposit fibers and resin to form a web;

a transferring unit configured to transfer, in a transfer direction, the web that includes the fibers and the resin deposited on the transferring unit, the transferring unit including a first transferring unit having a first surface that is flat and a second transferring unit disposed downstream in the transfer direction relative to the first transferring unit, the second transferring unit having a second surface configured to receive the web that is transferred from the first transferring unit, the first and second transferring units being configured to transfer the web such that, in response to transferring the web from the first surface to the second surface, a first direction in which the web is transferred on the first surface is changed by not less than 90 degrees to a second direction in which the web is transferred on the second surface; and a heating unit configured to heat the web, the web forming unit being configured to deposit the fibers and the resin on the first surface to form the web.

* * * * *